United States Patent [19]

Skwirut et al.

[11] 4,300,073

[45] Nov. 10, 1981

[54] SCREW-IN TYPE LIGHTING UNIT HAVING A CONVOLUTED TRIDIMENSIONAL FLUORESCENT LAMP

[75] Inventors: Henry Skwirut, Verona; Robert G. Young, Nutley; Edward W. Morton, Teaneck, all of N.J.

[73] Assignee: Westinghouse Electric Corp., Pittsburgh, Pa.

[21] Appl. No.: 11,832

[22] Filed: Feb. 13, 1979

[51] Int. Cl.[3] ..... H01J 17/34; H01J 61/56; H01J 17/28

[52] U.S. Cl. ..... 315/53; 313/493; 313/220; 315/50; 315/59

[58] Field of Search ..... 313/204, 493, 205, 204, 313/220; 315/53, 57, 58, 59, 62, 50

[56] References Cited

U.S. PATENT DOCUMENTS

| | | | |
|---|---|---|---|
| 1,898,615 | 2/1933 | Byrnes | 313/204 X |
| 2,001,511 | 5/1935 | Uyterhoeven et al. | 313/204 X |
| 2,200,940 | 5/1940 | Uyterhoeven et al. | 313/204 X |
| 2,561,868 | 7/1951 | Jenkins et al. | 313/205 X |
| 2,652,483 | 9/1953 | Laidig et al. | 313/204 |
| 2,831,152 | 4/1958 | Dziergwa | 313/204 X |
| 3,501,662 | 3/1970 | Plagge | 313/220 X |
| 3,521,120 | 7/1970 | Anderson | 315/57 |
| 3,551,736 | 12/1970 | Doehner | 313/204 X |
| 3,815,080 | 6/1974 | Summa | 315/57 |
| 3,833,828 | 9/1974 | Vivari | 313/111 |
| 3,899,712 | 8/1975 | Witting | 313/220 X |
| 3,953,761 | 4/1976 | LoGiudice | 315/57 X |
| 4,093,893 | 6/1978 | Anderson | 315/49 |
| 4,199,708 | 4/1980 | Lauwerijssen et al. | 313/493 |
| 4,208,604 | 6/1980 | Couwenberg | 313/493 |

FOREIGN PATENT DOCUMENTS

| | | | |
|---|---|---|---|
| 239741 | 9/1959 | Australia | 313/204 |
| 837892 | 5/1952 | Fed. Rep. of Germany | 315/70 |
| 49-28293 | 8/1974 | Japan | 313/493 |
| 49-28294 | 8/1974 | Japan | 313/493 |
| 49-28295 | 8/1974 | Japan | 313/493 |
| 417747 | 10/1934 | United Kingdom | 313/493 |
| 525943 | 9/1940 | United Kingdom | 313/493 |
| 645346 | 11/1950 | United Kingdom | 313/493 |
| 854745 | 11/1970 | United Kingdom | 313/204 |
| 2003314 | 3/1979 | United Kingdom | 313/493 |
| 2033653 | 5/1980 | United Kingdom | 313/493 |

*Primary Examiner*—Alfred E. Smith
*Attorney, Agent, or Firm*—D. S. Buleza

[57] ABSTRACT

A fluorescent lamp having a triple-U-bent tubular envelope is combined with circuit means, a translucent protective cover and a threaded base member to provide an efficient screw-in type lamp unit of high brightness and long life that is compact enough to be used as a direct replacement for incandescent type lamps in fixtures designed for residential and commercial lighting. Various structural arrangements for including the ballast and starter components of the energizing circuit as integral parts of the compact lamp unit, despite the stringent space limitations, and also venting the cover and base structures to provide convection cooling of the compacted electrical components are also disclosed. Additional cost-saving advantages are afforded by making the triple-U-bent fluorescent lamp a plug-in type component that can be readily removed from the lamp unit and replaced with a new fluorescent lamp, thus permitting the lamp unit to be retained as a permanent part of the lighting fixture and be periodically relamped at minimal expense as required to maintain the optimum amount of illumination from the electrical energy which is consumed.

30 Claims, 11 Drawing Figures

SCREW-IN TYPE LIGHTING UNIT HAVING A CONVOLUTED TRIDIMENSIONAL FLUORESCENT LAMP

CROSS-REFERENCE TO RELATED APPLICATION

This application discloses and claims a compact lamp unit which employs a triple-U-bent fluorescent lamp component of the type disclosed and claimed in concurrently-filed application Ser. No. 11,836, of F. W. Hoeh, entitled "Fluorescent Lamp Having A Tubular Envelope Of Compact Tridimensional Configuration, And Method Of Making Such Envelope", which application is assigned to the assignee of this application.

BACKGROUND OF THE INVENTION

1. Field of the Invention

This invention relates to electric lamps and has particular reference to a compact fluorescent lamp unit that is adapted for use as a direct replacement for incandescent type lamps in lighting fixtures employed for residential and commercial illumination.

2. Description of the Prior Art

Fluorescent lamp units having integral circuit and base components which permit the unit to be screwed into and operated in the sockets of lighting fixtures that are designed for incandescent type lamps are generally well known in the art. A lamp unit of this type having a cylindrical envelope that contains concentric annular partitions (or which is made from tubing that is bent upon itself to provide a U-shaped bulb) is disclosed in U.S. Pat. No. 3,551,736 granted Dec. 29, 1970 to Doehner. As disclosed in FIG. 5 and at lines 24–30, column 2 of this patent, if a tubular U-shaped bulb is used as the envelope it may be additionally twisted into spiral shape or redoubled on itself to provide a generally M-shaped envelope. A lamp assembly having adapter means which accommodates a conventional straight tubular fluorescent lamp and contains a ballast transformer that is part of a threaded base member which permits the lamp assembly to be screwed into an incandescent lamp socket is disclosed in U.S. Pat. No. 3,815,080 granted June 4, 1974 to F. Summa.

According to a more recent development, a screw-in type fluorescent lamp bulb is provided with integral ballast means that is disposed in telescoped relationship with an envelope that defines a discharge space of flat toroidal shape of similar configuration. A lamp unit of this type is disclosed in U.S. Pat. No. 3,953,761 granted Apr. 27, 1976 to T. Giudice. Another fluorescent lamp assembly of this general type having a tapered cylindrical envelope of molded glass that defines a helical-shaped discharge channel and accommodates a ballast component is described in U.S. Pat. No. 3,899,712 issued Aug. 12, 1975 to H. Witting.

An electrodeless fluorescent lamp unit of the screw-in type that is energized by high frequency energy produced by a self-contained radio-frequency oscillator and ferrite core is disclosed in U.S. Pat. No. 3,521,120 granted July 21, 1970 to J. M. Anderson.

Electric discharge lamps having tubular envelopes which are bent into various shapes to provide concentrated sources of light are also generally well known in the art. A sodium-vapor discharge lamp of double-ended construction having an envelope formed from a vitreous tube that is folded or bent upon itself twice to provide three straight segments that are disposed in triangular-spaced relationship is disclosed in British Pat. No. 854,745 published Nov. 23, 1960 (FIGS. 3 and 4 embodiment). A luminous discharge tube designed for advertising and display purposes (of for use as a beacon light) and having thimble-like electrodes and an envelope which is formed from glass tubing bent upon itself eleven times to provide a corresponding number of conjoined U-shaped sections is disclosed in U.S. Pat. No. 1,898,615 granted Feb. 21, 1933 to Byrnes. A plug-in type discharge lamp having a tubular envelope that is bent upon itself three times to provide a multi-segment envelope which is disposed within a heat-conserving double-walled enclosure is disclosed in U.S. Pat. Nos. 2,001,511 and 2,200,940 granted to Uyterhoeven et al.

Fluorescent lamps having "three-dimensional" type envelopes that are formed by coupling several arcuate lamp components together or interconnecting several straight tubular bulbs in "bundled" configuration are also known in the art and are disclosed in U.S. Pat. No. 2,652,483 (Laidig et al.) and U.S. Pat. No. 3,501,662 (Plagge), respectively.

SUMMARY OF THE INVENTION

While it has long been realized in the prior art that the physical size of a fluorescent lamp could be decreased to provide a brighter light source by using partitioned or bent multi-segment tubular envelopes, lamp units employing such concepts were impractical from a commercial standpoint since they required special electrode and seal structures and/or envelopes that were very difficult and expensive to make on a mass production basis. In many cases the envelopes were also so configured that the physical dimensions of the lamp unit which contained integral circuit components and was fitted with a screw-in type base component were too large to permit the lamp unit to be used in lighting fixtures and sockets designed for incandescent lamps. Another serious shortcoming of the prior art screw-in type fluorescent lamp units was that, when they were made small enough to fit into incandescent lamp fixtures and sockets, they were unable to generate a sufficient amount of light to provide illumination comparable to that obtained with an incandescent lamp, or to produce such illumination without radio-frequency interference and at a level of efficiency that would justify the added initial expense of such lamp units.

The foregoing manufacturing problems and commercial disadvantages are overcome in accordance with the present invention by providing a screw-in type lamp unit which contains a fluorescent lamp that has a tubular envelope of tridimensional-convoluted configuration. The envelope is of triple-U-bent construction and so shaped that it not only permits conventional stem and electrode components to be employed but physically accommodates circuit means and a threaded base in such a manner that the resulting lamp unit is small enough to be used in sockets and lighting fixtures designed for incandescent type lamps and produces light of an intensity comparable to that obtained from such incandescent lamps.

Since the fluorescent lamp component employed in the new lamp unit is basically a conventional straight tubular fluorescent lamp that has been bent into convoluted form, it employs the same components and basic technology used to manufacture standard type fluorescent lamps and thus can be made at a reasonable cost and will have the excellent light output and efficacy, as well as the long useful life, exhibited by conventional fluorescent lamps now being marketed and in use. The improved fluorescent lamp unit provided by the present invention accordingly has the requisite physical compactness, light output, and high level of quality and performance needed to make it a practical and energy-conserving substitute for incandescent type lamps.

In accordance with one embodiment, the tubular leg segments of the U-shaped sections of the convoluted fluorescent lamp envelope are arranged in spaced quadrangular columnar relationship to provide a central opening that accommodates an elongated choke ballast and thus reduces the size of the lamp unit without materially decreasing its light output. In another embodiment, the ballast and starter components are located within the base structure to provide a fluorescent lamp unit that is more elongated but of smaller width dimension.

Experimental fluorescent lamp units embodying the present invention and containing integral ballast and starter components which permit the units to be operated from conventional 120 volt alternating-current power outlets have outputs in the order of 1,000 lumens and system efficiencies of approximately 40 lumens per watt and are compact enough to be used in table lamps and similar lighting fixtures that are employed in homes and offices and were specifically designed for incandescent type lamps.

Another important feature of the present invention is the use of a protective cover or housing which diffuses the intense light from the convoluted fluorescent lamp in a pleasing manner and has vent openings that cooperate with similar openings in the base structure to permit air to circulate through the lamp unit during operation and thus dissipate heat generated by the lamp and circuit components. The resulting convection cooling of the operating lamp unit is very advantageous since it prevents the fluorescent lamp and integral circuit components from becoming overheated during operation and thus becoming less efficient, despite the compactness of the lamp unit. Such cooling also provides the option of using convoluted fluorescent lamp components that have higher light outputs, in the order of 2,000 lumens for example.

BRIEF DESCRIPTION OF THE DRAWINGS

A better understanding of the invention will be obtained from the exemplary embodiments shown in the accompanying drawings, wherein.

DESCRIPTION OF THE PREFERRED EMBODIMENTS

While the present invention can be advantageously employed in various kinds of lamp assemblies that are suited by virtue of their small physical size and high brightness for lighting homes or offices, it is particularly adapted for use in conjunction with screw-in type lamp units that employ low-pressure type discharge lamps such as fluorescent lamps as the light source and it has, accordingly, been so illustrated and will be so described.

Figure 1:
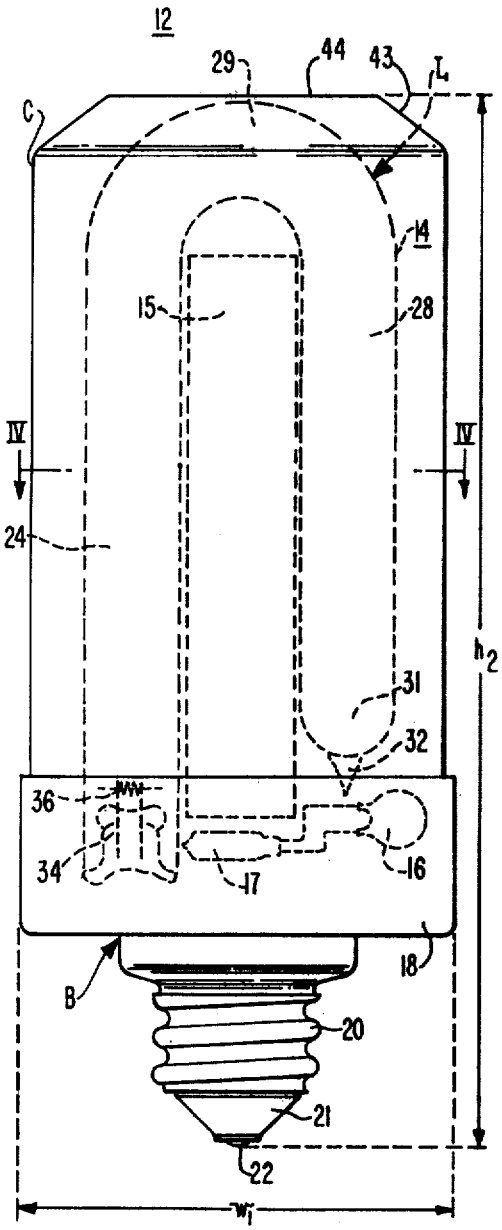
FIG. 1 is a side elevational view of a compact fluorescent lamp unit that embodies the invention, the convoluted lamp and circuit components being shown in phantom outline to indicate their locations within the unit.

A compact fluorescent lamp unit 12 embodying the invention is shown in FIG. 1 and consists of three basic components—namely, a fluorescent lamp L having a tubular envelope 14 of convoluted configuration which provides a concentrated light source of high efficacy and brightness as hereinafter explained, a light-transmitting housing such as a cover C that protectively encloses the fluorescent lamp L, and a base structure B that is coupled to the sealed ends of the lamp envelope 14 and holds the fluorescent lamp L in assembled relationship with the cover C and the various integral components of a circuit which permits the lamp unit 12 to be operated on an alternating-current power source.

As will be noted, in this embodiment the circuit means comprises an elongated ballast component 15 (that is located in the space between the U-bent sections of the convoluted fluorescent lamp envelope 14) and a conventional condenser 16 and starter 17 that are connected with the ballast 15 and the lamp electrodes in the usual manner. The base structure B has a cup-shaped portion 18 that accommodates and contains the sealed ends of the fluorescent lamp envelope 14 as well as the condenser 16 and starter 17. The base structure B is terminated by a suitable electrical connector component, preferably a threaded base member 20 having the usual insulator 21 and end contact 22. The threaded base member 20 is of a type that will fit the threaded sockets designed for incandescent type lamps so that the single-ended fluorescent lamp unit 12 can be screwed into and be operated in such sockets.

Figure 2:
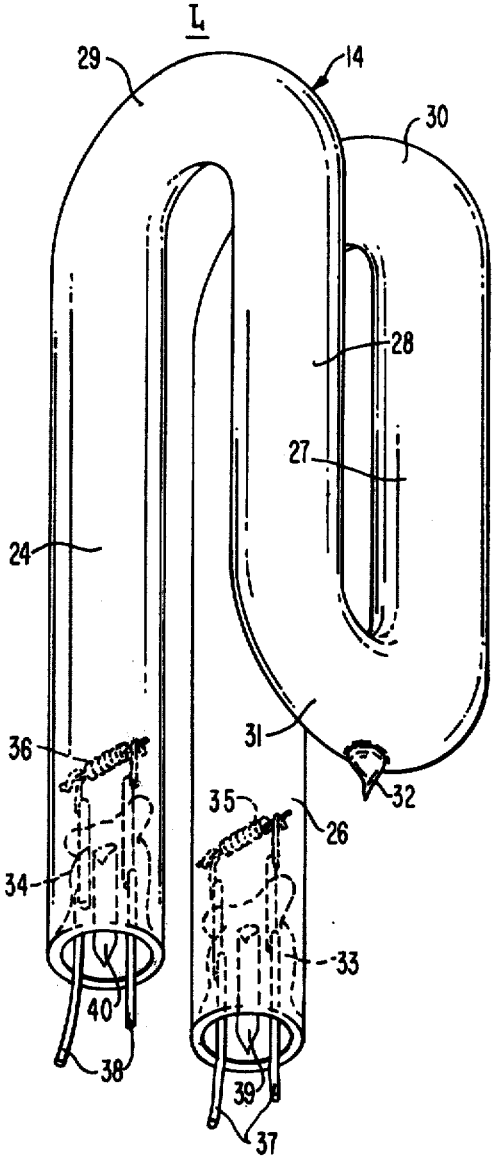
FIG. 2 is a pictorial view of the triple-U-bent fluorescent lamp component employed in the lamp unit shown in FIG. 1.

As shown more particularly in FIG. 2, the envelope 14 of the fluorescent lamp L comprises a vitreous tube that is bent in a manner such that it has four substantially straight leg segments 24, 26, 27, 28 that extend in the same direction and are joined by three U-bent segments 29, 30, 31. The U-bent segments are of such curvature and so oriented that the tubular leg segments are disposed in quadrangular columnar array and spaced from one another. The leg segments and U-bent segments accordingly form three conjoined U-shaped envelope sections that are located in three different planes and define a single discharge channel of serpentine configuration that is terminated by leg segments 24, 26. The envelope 14 is, accordingly, of triple-U-bent tridimensional form and very compact.

As shown, the U-bent segment 31 which constitutes the medial portion of the convoluted envelope 14 has a tipped-off segment 32 of a glass tubulation that is used to drain phosphor paint from the envelope during the phosphor-coating operation and ensure that the medial U-bent section is coated with a uniform layer of phosphor material. Insofar as the compact fluorescent lamp L operates at rather high loading, the tipped-off segment 32 affords an additional advantage in the finished lamp since it defines a cavity inside the envelope 14 that serves as a "cool spot" and thus functions as a reservoir for condensed mercury that controls the mercury vapor pressure during lamp operation. The leg segments 24, 26 extend beyond the medial U-bent segment 31 and are hermetically sealed by conventional stem components 33, 34 which include the usual tungsten-coil electrodes 35, 36 that are coated with suitable electron-emission material and connected to suitable conductors such as paired lead-in wires 37, 38 that extend through the respective stems and beyond the sealed ends of the envelope 14. Each of the stems have a sealed-off remnant 39, 40 of an exhaust tubulation which permits the convoluted envelope 14 to be evacuated and then charged with a suitable fill gas and dosed with mercury in accordance with standard lamp-making practice.

If desired, non-tubulated type stems can be used and the evacuation, gas-filling and mercury-dosing operations can be done through the tubulation extending from U-bent segment 31.

As will also be apparent to those skilled in the art, a straight tubular envelope can be phosphor coated, lehred, and provided with stem assemblies to form a partly-fabricated fluorescent lamp which can then be bent into the desired triple-U-bent configuration. The resulting convoluted phosphor-coated embryonic discharge lamp can then be completed by exhausting, gas-filling, and mercury-dosing through a tabulation which is provided on one or both of the stems. With this mode of lamp manufacture, there would be no tipped-off tabulation on the medial U-bent segment of the fluorescent lamp.

As will be noted in FIGS. 1 and 2, the sealed legs 24, 26 of the envelope 14 extend beyond the medial U-bent segment 31 and are disposed in side-by-side paired relationship on the same side of such segment. These are important structural features of the invention since they provide an unobstructed space or central opening that extends upwardly from the base structure B into the triple-U-bent envelope 14 between the leg segments 24, 26, 27, 28, and a smaller space below U-bend 31 adjacent the sealed ends of the legs 24, 26. As illustrated in FIG. 1, the provision of such spaces permits the elongated ballast component 15 to be placed in telescoped nestled relationship with the convoluted lamp envelope 14 and provides room for recessing the condenser 16 and starter 17 within the base structure B adjacent the sealed ends and beneath the medial U-bent segment of the envelope. The circuit components thus constitute integral parts of the compact lamp unit 12 and are located within its physical confines.

Since the tubular leg segments 24, 26, 27, 28 of the triple-U-bent envelope 14 extend in the same direction and are disposed substantially parallel to one another in quadrangular and columnar-spaced array, the overall configuration of the fluorescent lamp L is such that it is generally cubical or tetrahedral in character. When the lamp L is energized it thus constitutes a three-dimensional source of light which, while very compact, still has a single discharge channel that is about four times the height of the envelope 14 and thus permits the lamp to be operated efficiently at a voltage and current compatible with the electrical power supplied to homes and offices.

As indicated in FIG. 1, the width dimension $w_1$ of the lamp unit 12 is governed by the diameter of the circular cup-shaped portion 18 of the base structure B required to accommodate the cylindrical protective cover C and is thus only slightly larger than the width of the convoluted lamp L. The height dimension $h_2$ of the lamp unit 12 is determined by the combined lengths of the convoluted lamp L and base structure B. Due to the triple-U-bent configuration of the lamp L and the interfitting of the envelope 14 with the circuit components and cup-shaped portion 18 of the base structure B, the height dimension $h_2$ of the lamp unit 12 is drastically reduced.

While the convoluted lamp envelope 14 can be made by joining three U-bent sections of vitreous tubing together, it is preferably formed from a single piece of lead glass tubing of the kind used for conventional fluorescent lamp bulbs. The glass tubing is bent at the proper points to form the U-bends and is subsequently coated with phosphor and provided with stem assemblies, etc., in the usual manner. The envelope 14 is charged with a suitable ionizable medium such as a fill gas and a measured dose of mercury that are introduced into the envelope through the exhaust tubes of the stems 33, 34 before they are tipped-off and sealed. A suitable fill gas is argon at a pressure below about 10 torrs, and preferably about 3 torrs. The mercury dosage will vary according to the physical size of the lamp L and the power loading at which it is operated but is sufficient to provide mercury vapor at a partial pressure of from about 6 to 10 millitorrs when the lamp is operated at its rated wattage, and maintain the mercury vapor pressure at this level within the lamp throughout its useful life.

While any suitable phosphor (or mixture of phosphors) can be used to form the luminescent coating deposited on the inner surface of the convoluted tubular envelope 14, in lighting applications where optimum visual clarity and color rendition of the illuminated objects or area are required, phosphor coatings which contain a blend of three phosphors that emit visible radiations in three different selected regions of the spectrum (specifically, the wavelength regions of about 450 nm, 540 nm and 610 nm) are desirably employed to provide a so-called "prime color" fluorescent lamp L, pursuant to the teachings of W. A. Thornton in the article entitled "Luminosity and Color-Rendering Capability Of White Light", *Journal of the Optical Society of America*, Vol. 61, No. 9 ( September 1971), pages 1155–1163. As a specific example, a suitable phosphor blend for a triple-U-bent fluorescent lamp having such an enhanced light output contains manganese-activated zinc silicate phosphor, europium-activated strontium chlorophosphate phosphate, and europium-activated yttrium oxide phosphor—all of which are well known to those skilled in the art. Alternatively, the envelope 14 can be coated with "Cool White" or "Warm White" halophosphate type phosphors (or any other kind of phosphor or phosphor mixtures) employed in conventional fluorescent lamps.

Figure 3:
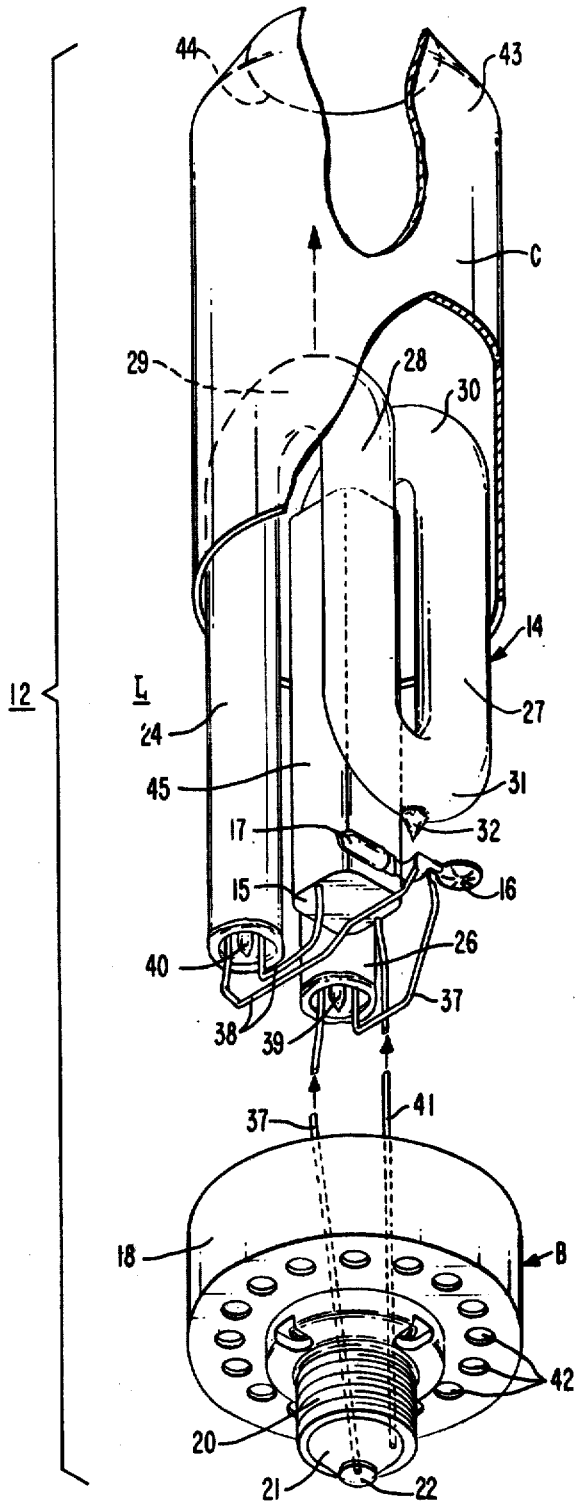
FIG. 3 is an exploded perspective view of the fluorescent lamp unit shown in FIG. 1.
Figure 4:
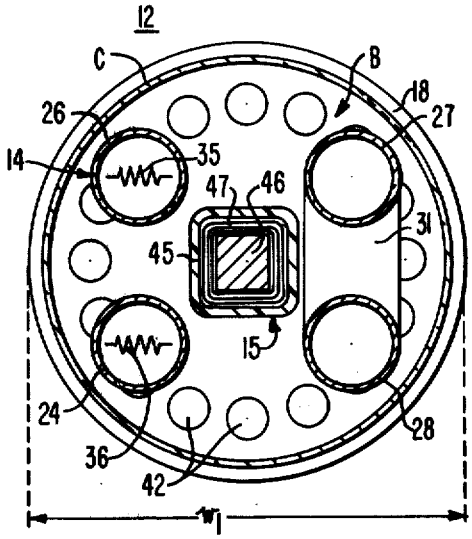
FIG. 4 is a cross-sectional view through the lamp unit along line IV—IV of FIG. 1.

As shown more particularly in FIGS. 3 and 4, the compact fluorescent lamp unit 12 is fabricated by first inserting the elongated ballast component 15 in nestled position within the leg segments 24, 26, 27 and 28 of the convoluted envelope 14 and then connecting the ballast, condenser 16 and starter component 17 to the insulated lead wires 37, 38 and socket contacts in the manner illustrated in FIG. 3 (a separate insulated conductor 41 being employed to connect one side of the ballast 15 with the shell contact of the screw base 20). The end contact 22 of the base 20 is connected by one of the lead wires 37 directly to one of the lamp electrodes so that the ballast 15 is connected in series with the electrodes. The condenser 16 and starter 17 are connected in the usual manner to start the fluorescent lamp L in preheat fashion when the lamp unit 12 is connected to an alternating-current power source.

The convoluted fluorescent lamp L and its attached circuit components are then mounted in upstanding position within the cup-shaped end portion 18 of the base structure B, secured to the latter by suitable means (not shown) such as cement or an interlocking support member that couples the sealed legs 24, 26 of the envelope 14 to the base structure, and the conductors 37 and 41 are fastened to the base contacts by soldering or the like. The resulting subassembly (consisting of the convoluted fluorescent lamp L, connected circuit components and coupled base structure B) is then inserted into the protective cover C until the rim of the cover is firmly seated within and frictionally held by (or otherwise secured to) the cup-shaped end 18 of the base structure B.

Since the convoluted fluorescent lamp L and integral circuit components are confined within a very small space, care must be taken to prevent the operating lamp unit 12 from overheating since this would cause the lamp efficacy to decrease and could create a potential safety hazard. These problems are avoided in accordance with the invention by providing a plurality of vent apertures 42 (see FIGS. 3 and 4) that are spaced along the bottom wall of the cup-shaped portion 18 of the base structure B, and by utilizing a protective cover C which consists of a cylindrical sleeve having a tapered end 43 with a central opening 44, which opening (in conjunction with the vent apertures 42 in the base structure) permits the free circulation of air through the operating lamp unit 12 in chimney-like fashion. The resulting "convection cooling effect" dissipates heat generated by the fluorescent lamp L and ballast component 15 and ensures that they do not become too hot.

In order to minimize light looses, the ballast component 15 is desirably covered by a sheath 45 (shown in FIGS. 3 and 4) of suitable white or light-colored insulating material such as a heat-resistant tape or plastic. Of course, a metal case can also be used as the light-reflective sheath instead of the tape or plastic, providing due care is taken to insulate the ballast from the metal case. As will be noted in FIG. 4, the ballast component 15 desirably comprises a so-called "finger" type choke ballast that has an iron core 46 which is overwound with insulated wire 47 and encased in the light-reflective sheath 45.

The cup-shaped support portion 18 of the base structure B can be formed from suitable metal such as aluminum, providing the conductors which connect the circuit components to the lamp electrodes are properly insulated to prevent short circuits. The screw-in base member 20 is preferably of the "medium" screw type and can be secured to the bottom wall of the cup-shaped support 18 with suitable fasteners, or it can be formed as an integral part of the cup-shaped support 18 by stamping the cup-shaped member and base shell from a single piece of metal (or by molding it from suitable plastic).

The protective cover C can be made of glass, heat-resistant plastic or other suitable transparent or translucent material that will not absorb the light rays generated by the fluorescent lamp L. If transparent material is used, it may be made translucent by a white light-diffusing coating (or other means) to reduce glare from the bright surface of the triple-U-bent lamp L and to provide a more uniform and pleasing lighted appearance.

The starter component 17 is of the conventional "glow lamp" type that is permanently wired in place. However, it could be made in the form of a fuse-like component and mounted within the base structure B in such a manner that it may be readily removed and replaced as necessary by a twist-lock action. The condenser 16 is of the miniature wafer type and is connected in the circuit in such a fashion that it eliminates or minimizes radio interference during lamp starting.

ALTERNATIVE COMPACT LAMP UNIT EMBODIMENT (FIGS. 5–7)

Figure 5:
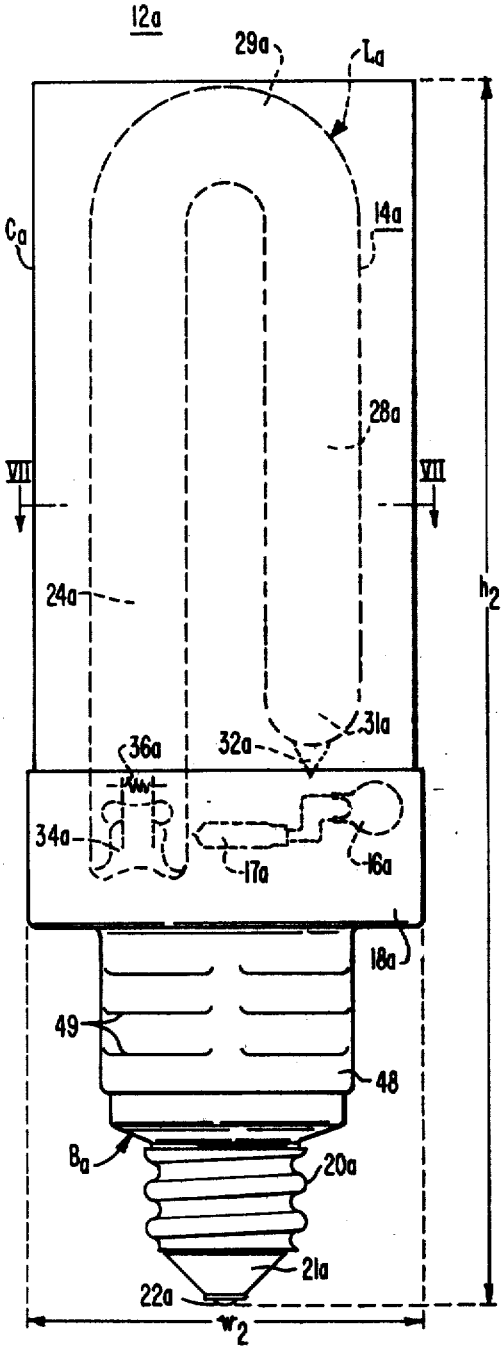
FIG. 5 is a side elevational view of an alternative compact fluorescent lamp unit embodying the invention.
Figure 7:
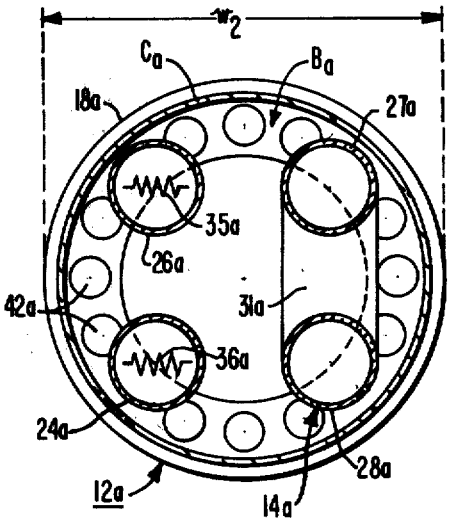
FIG. 7 is a cross-sectional view of the alternative lamp unit, taken along line VII—VII of FIG. 5.
Figure 6:
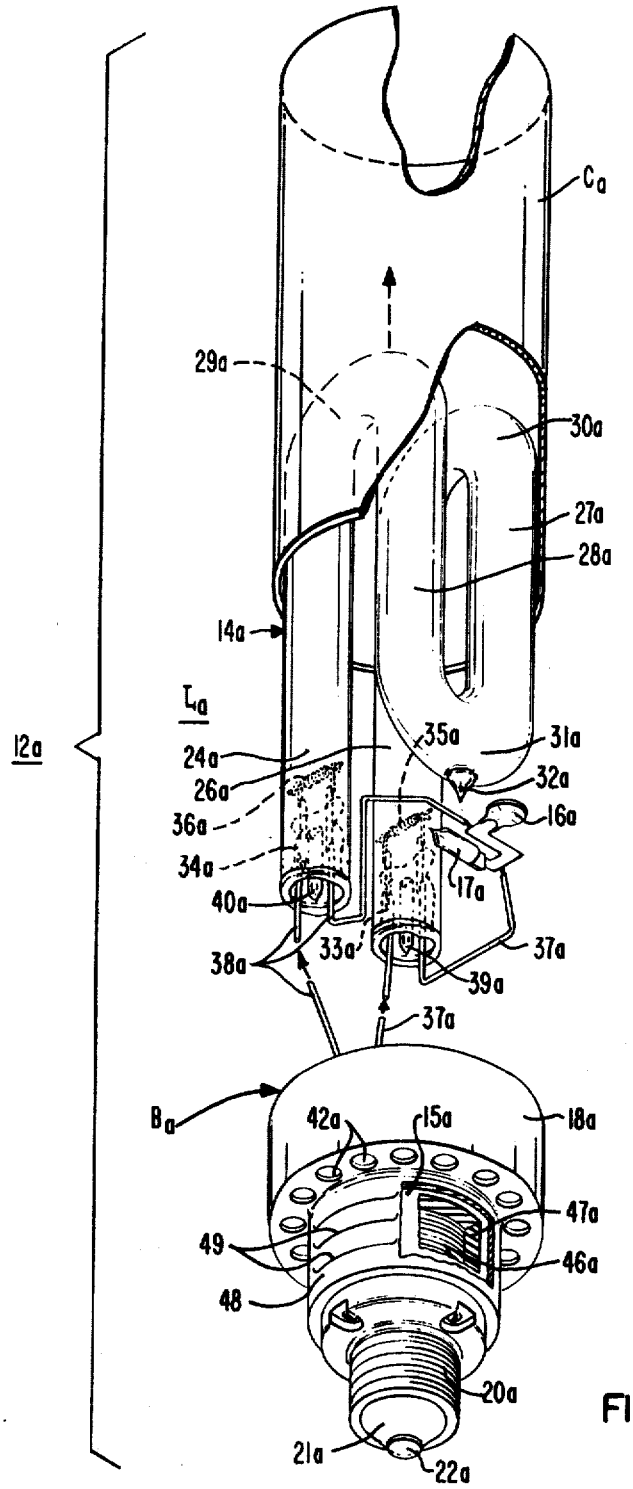
FIG. 6 is an exploded pictorial view of the alternative lamp unit shown in FIG. 5.

An alternative compact lamp unit **12*a*, shown in FIGS. 5–7**, employs a ballast component that is "built into" the base structure $B_a$ and thus provides a lamp unit which is slightly longer but smaller in diameter or width dimension than the embodiment just described.

As illustrated in FIGS. 5 and 6, the ballast component **15*a* according to this embodiment is of truncated cylindrical shape rather than elongated slender configuration and is located within a similarly shaped extension 48 that protrudes from the bottom of the cup-shaped portion 18*a* of the base structure $B_a$ and is joined to the threaded base member 20*a*. The ballast 15*a* is again preferably of the choke type and consists of an iron core (not shown) and a wire winding 47*a* that are encased in a suitable sheath or covering 45*a* of nonconductive material (see FIG. 6). The wall of the cylindrical extension 48 is spaced from the ballast component 15*a* and is provided with a series of laterally extending vent openings 49 which permit air to circulate freely around the ballast component and through the base structure $B_a$ when the lamp unit 12*a*** is energized and in use.

As will be noted in FIG. 6, the triple-U-bent fluorescent lamp $L_a$ is identical to that employed in the previous embodiment except that the U-bent segments **29*a*, 30*a*, 31*a* have a smaller radius of curvature and thus reduce the spacing between the tubular leg segments 24*a*, 26*a*, 27*a*, 28*a*. The condenser 16*a* and starter 17*a* are connected by the insulated lead-in wires 38*a*, 37*a* to the ballast component 15*a* and lamp electrodes 35*a*, 36*a* and the condenser and starter components are disposed within the cup-shaped end 18*a* of the base structure $B_a$ (in the space beneath the medial U-bend 31*a* alongside the sealed legs 24*a*, 26*a* of the envelope 14*a* as in the previous embodiment). The protective cover $C_a$ is modified and consists of a cylindrical sleeve (of translucent or transparent material) that is open at both ends and is seated in and gripped by the circular cup-shaped portion 18*a*** of the base structure $B_a$.

As indicated in FIGS. 5 and 7, the placement of the ballast component **15*a* within the base structure $B_a$ increases the overall length $h_2$ of the lamp unit 12*a* but permits a "tighter bundling" of the tubular leg segments of the convoluted envelope 14*a* with a resultant decrease in the width dimension $w_2$ of the lamp unit, compared to the corresponding dimensions of lamp unit 12**.

As in the previous embodiment, heat generated by the triple-U-bent fluorescent lamp $L_a$ and the integral circuit components is dissipated by convection cooling produced by the air which circulates through the energized unit through the vent openings **42*a* and 49** in the base structure $B_a$ and out of the open end of the tubular protective cover $C_a$.

ADDITIONAL ALTERNATIVE LAMP UNIT EMBODIMENT (FIG. 8)

Figure 8:
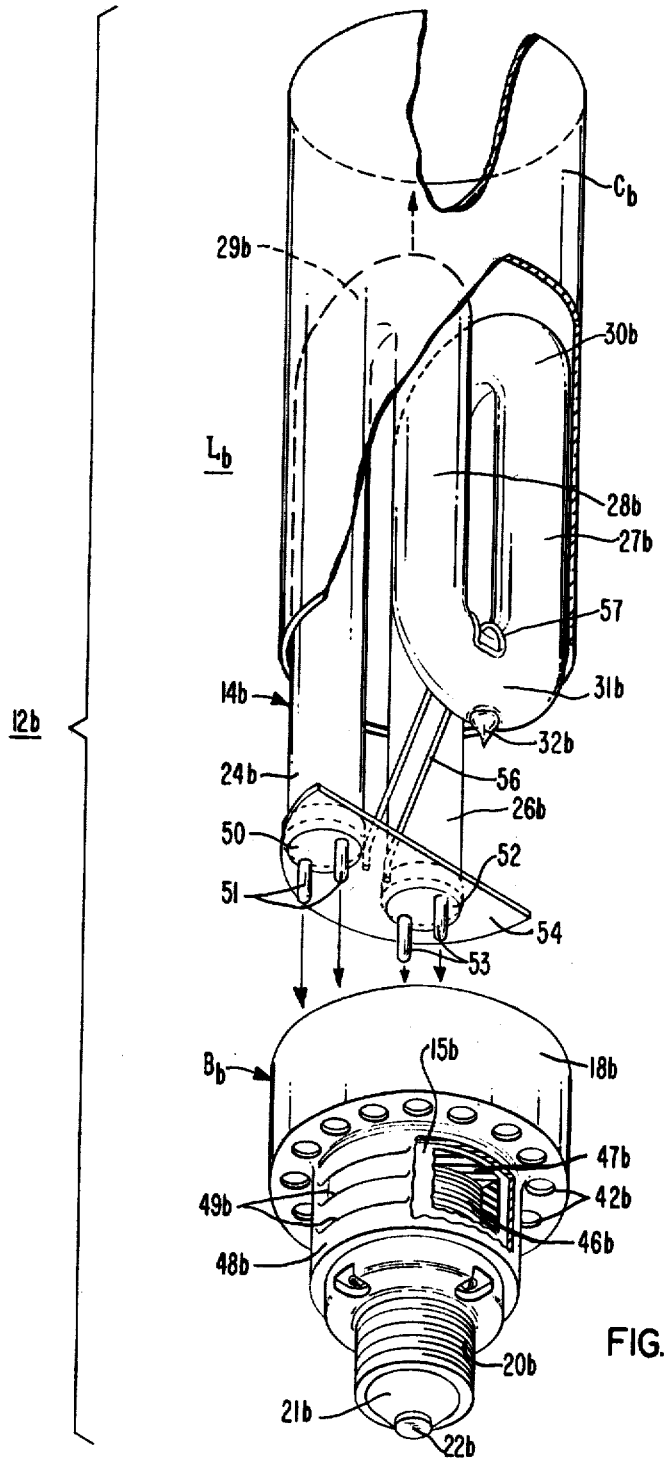
FIG. 8 is an exploded pictorial view of still another embodiment of a compact fluorescent lamp unit according to the invention; and, FIGS. 9–11 are longitudinal sectional views of alternative embodiments of protective cover components for the compact lamp units.

From the standpoint of the consumer, it would be very advantageous financially to be able to remove and replace only the convoluted fluorescent lamp component of the lamp unit and retain the base structure, protective cover and circuit components as permanent parts of the lighting fixture in which the lamp unit is used. A lamp unit 12b which provides this cost advantage is shown in FIG. 8 and will now be described.

As will be noted, the fluorescent lamp $L_b$ has the same triple-U-bent type tubular envelope 14b as in the previous embodiments except that the sealed ends of the leg segments 24b and 26b are fitted with small plug-in type base members 50, 52. These base members have protruding contact elements such as rigid pins 51, 53 that are adapted to be inserted into aligned receptacles of a suitable socket member (not shown) located within the cup-shaped portion 18b of the base structure $B_b$. The resulting plug-in type electrical connection of the lamp component $L_b$ and the base structure $B_b$ permits the consumer to simply remove the cover $C_b$ and unplug and remove the lamp component (when it becomes inoperable or has reached the end of its useful life) and then plug in a new lamp component. Hence, the lamp unit 12b can be readily relamped by the user and the waste and added expense associated with discarding the entire lamp unit each time the fluorescent lamp "burns out" is avoided.

In order to rigidify the lamp envelope 14b and permit it to be handled without breaking, the plug-in base members 50 and 52 are desirably secured to a transverse panel member 54 of suitable nonconductive material. In addition, this panel member can be coupled to the medial U-bent segment 31b of the envelope by a suitable brace means such as a wire strut 56 that has a hooked end 57 which is slipped over and grips the medial U-bent segment. The panel member 54 is also desirably shaped to nestingly engage the cup-shaped end 18b of the base structure $B_b$ and seat against a part thereof in such a manner as to stabilize the fluorescent lamp $L_b$ in its upright assembled position relative to the base structure.

While the sealed ends of the convoluted tubular envelope 14b have been provided with pin-type base members, it will be appreciated by those skilled in the art that other kinds of bases and electrical coupling means can be employed which will permit the fluorescent lamp $L_b$ to be easily removed from the lamp unit 12b as a separate part by the user and replaced by a new lamp component.

In contrast to the previous embodiments, the starter and condenser components (not shown) are wired to the ballast component 15b and the plug-in socket means (also not shown) so that they constitute permanent integral parts of the base structure $B_b$. Alternatively, the starter and condenser could be mounted on top of panel member 54 and connected to the lamp lead-in wires in an appropriate manner so that all three of these connected components comprise a replaceable assembly that can be unplugged from the lamp unit. Of course, if the starter and condenser were connected to the lamp leads in the proper fashion, then only two pin contacts rather than four would be required.

As will also be noted in FIG. 8, the ballast component 15b is housed within a cylindrical extension 48b of the base structure $B_b$ so that it also constitutes a permanent integral part of the base structure. Vent openings 42b and 49b in the base structure $B_b$ permit free circulation of air around the ballast component 15b, through the cylindrical jacket or cover $C_b$ past the triple-U-bent lamp $L_b$, and through the open end of the cover. The base structure $B_b$ is terminated by a threaded base member 20b having exposed contacts so that the lamp unit 12b is once again of single-ended construction and adapted to be screwed into an incandescent-type lamp socket.

ALTERNATIVE COVER EMBODIMENTS (FIGS. 9–11)

Figure 9:
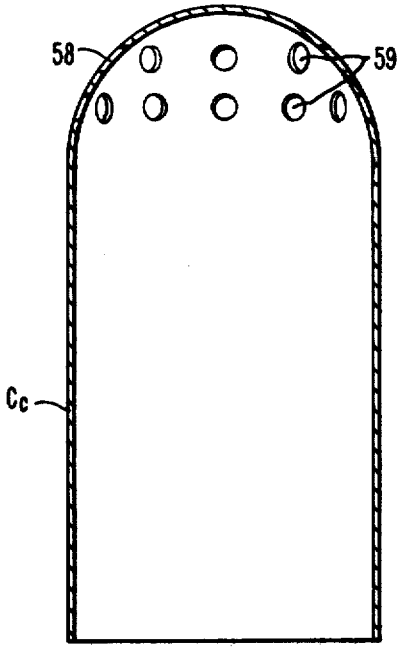

The compact discharge lamp units of the present invention can be fitted with various types of protective jackets or covers in addition to those previously described. For example, the light-transmitting cover can be closed at one end by a dome that is provided with suitable vent openings to permit the free passage of air. A cover $C_c$ having these features is illustrated in FIG. 9 and consists of a light-transmitting sleeve of tubular or cylindrical shape that is terminated by a dome 58 having a plurality of circular apertures 59 that are distributed in a predetermined spaced pattern.

Figure 10:
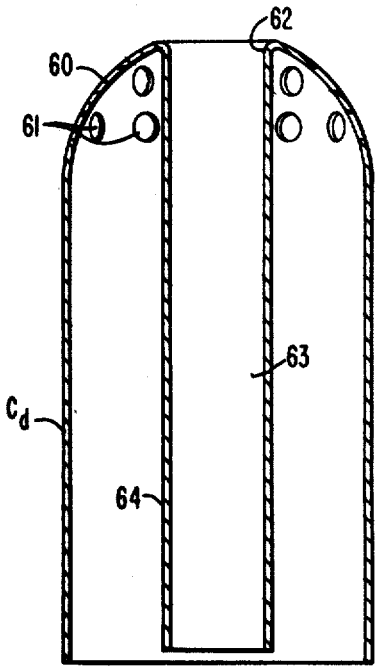

A modified domed-end type protective cover $C_d$ that is specifically designed for a compact lamp unit having an upstanding elongated ballast component disposed in nestled relationship within the holes of the triple-U-bent lamp is shown in FIG. 10. As will be noted, this cover consists of a cylindrical sleeve that is also terminated by a domed end 60 which, in addition to a plurality of spaced apertures 61, also has a central opening 62 that communicates with a longitudinally-extending passageway 63 which is defined by a coaxially disposed tube 64 that is joined to and merges with the domed end 60. The axial passageway 63 is located to accommodate the elongated ballast component of the lamp unit and is dimensioned to fit between the U-bent sections of the triple-U-bent envelope when the cover $C_d$ is secured to the base structure of the lamp unit. The passageway 63 is also slightly larger than the ballast component and thus serves as a "chimney" that enables air to circulate freely through the lamp unit from the vent openings in the base structure, around and along the ballast component and then through the central opening 62 in the domed end 60 of the cover $C_d$. The U-bent sections of the convoluted envelope are disposed in the annular space between the coaxial tube 64 and cylindrical wall of the cover $C_d$ and are thus exposed to air which circulates through this space from the base structure of the lamp unit and through the dome apertures 61.

Figure 11:
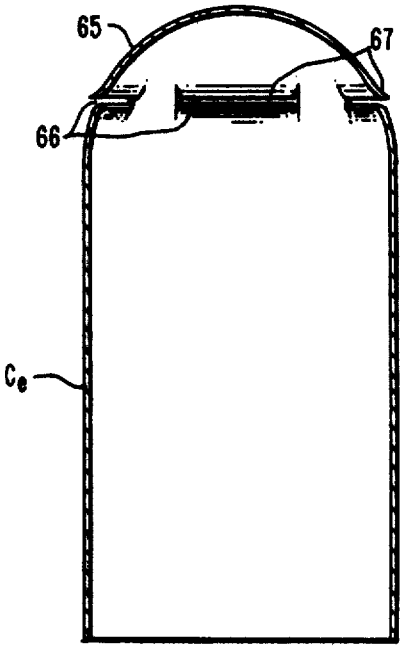

Another form of domed cover $C_e$ is shown in FIG. 11 and consists of a light-transmitting sleeve of tubular or cylindrical configuration having a domed end wall 65 that is provided with a plurality of spaced circumferentially-extending vent openings 66 of slot-like configuration. The overlying portions of the cover $C_d$ are flared outwardly and form louvers 67 that serve as protective shrouds or hoods for the vent openings.

SPECIFIC EXAMPLES

A better appreciation of the compactness and advantageous energy-conserving characteristics of the fluorescent lamp units provided by the present invention will be obtained from the following specific examples of two prototype units that have been made and are presently being tested.

A compact fluorescent lamp unit of the type shown in FIGS. 1-4 having a nested "finger" type choke ballast and a medium screw-type base was made by bending a tubular fluorescent lamp 20 inches (50.8 cms.) long and 0.69 inch (17.5 mm.) in outside diameter into triple-U-bent configuration so that the overall length of the convoluted lamp was approximately 5½ inches (14 cms.) and its width approximately 2¼ inches (5.7 cms.). The spacing between the medial U-bent section and sealed end legs of the envelope was about ⅞ inch (22.2 mm.) and the end legs were spaced about ½ inch (12.7 mm.) apart. An elongated "finger" choke ballast measuring about ¾"×¾"×4" (19 mm.×19 mm.×101.6 mm) was inserted in nestled relationship within the three U-bent sections of the fluorescent lamp and connected to the lead wires and a conventional type "glow-lamp" starter and wafer condenser used for standard preheat type fluorescent lamps.

The resulting subassembly was mounted on a 2 13/16 inch diameter (7.14 cms.) support member of the type shown in FIGS. 1 and 3 having ¼ inch (6.4 mm.) vent apertures and a medium screw-type base. A protective cover consisting of a frosted glass cylinder approximately 5½ inches (14 cms.) long and 2¾ inches (7 cms.) in diameter having a central opening of 1¾ inches (4.44 cms.) was slipped over the convoluted fluorescent lamp and seated in the cup-shaped support portion of the base structure.

The completed fluorescent lamp unit had an overall width dimension $w_1$ of 2 13/16 inches (7.14 cms.) and an overall height $h_1$ of about 7 inches (17.8 cms.). The triple-U-bent envelope was coated with "Cool White" halophosphate type phosphor and the lamp unit, when operated at 120 volts input at a current of 345 milliamperes, had an output of 1,000 lumens and a system efficacy (that is, the fluorescent lamp component in combination with the choke ballast) of approximately 37 lumens per watt. The total power comsumption of the lamp unit was approximately 27 watts (about 20 watts in the fluorescent lamp component and about 7 watts in the ballast).

A second prototype fluorescent lamp unit made in accordance with the FIGS. 5-7 embodiment contained a triple-U-bent fluorescent lamp which was formed from an envelope 20 mm. in diameter and 43.1 cms. long. The convoluted lamp component had an overall length of 13 cms., a width of 5.1 cms. and the legs of each of the U-bent sections were spaced 11 mm. apart. The lamp was mounted on a base structure having a cylindrical extension that housed a cylindrical choke ballast, the "glow-lamp" starter and the wafer condenser. The base structure has a circular cup-shaped end approximately 2⅞ inches (7.3 cms.) in diameter and a cylindrical open-ended cover of frosted glass having a diameter of about 2¾ inches (7 cms.) and an overall length of 5½ inches (14 cms.) was secured to the base structure. The resulting lamp unit has an overall with dimension $w_2$ of approximately 2⅞ inches (7.3 cms.) and an overall height dimension $h_2$ of approximately 8⅛ inches (20.6 cms.). When the lamp unit was operated at 120 volts input and 345 ma, it had a light output of approximately 960 lumens and a system efficacy of 40 lumens per watt.

While life tests on triple-U-bent fluorescent lamps of the type employed in the compact lamp units of the present invention have not been completed, the lamps should have useful lives in the order of 9,000 hours or so since, when mass-produced, they would be made with standard stem and electrode assemblies and utilize the well-known phosphor coating techniques and other technology used to manufacture conventional fluorescent lamps of equivalent size (15 to 20 watt rating) that have nominal life ratings of such magnitude.

In contrast, a standard 75 watt A19 type incandescent lamp produces about 1,210 lumens at an efficacy of about 16 lumens per watt and has an average life (published) of only 850 hours.

As will be apparent to those skilled in the art, the compact fluorescent lamp units of the present invention can employ triple-U-bent fluorescent lamps made from glass tubing of various diameters and lengths to provide lamp units having higher or lower wattage ratings and light outputs. The starting and/or operating circuits can also be made in the form of solid-state modules or components that are "built into" the base structure or mounted between the legs of the U-bent sections of the envelope to provide a new family of compact low-pressure discharge lamp units that can be advantageously used as cost-saving and energy-conserving replacements for incandescent-type lamps now employed for general lighting applications in homes and offices. The use of solid-state circuit means would be particularly advantageous in fabricating screw-in type lamp units having light outputs of 2,000 lumens or so since the miniaturized circuitry would still make it possible to keep the overall dimensions of such high-output lamp units within the limits required to permit the units to fit into and be used in table lamps and similar lighting fixtures designed for incandescent type lamps.

Of course, if the ballast and other circuit components were physically separated from the fluorescent lamp and made part of a specially-designed lighting fixture (for example, if they were housed within the base of a table lamp or floor lamp), then step-up transformers, high-frequency converters and similar energizing means can be used to increase the efficacy of the system and make the lamp units per se even more compact and economical. In addition, the ballast component can be physically separated from both the discharge lamp unit and the lighting fixture by making the ballast a "pass-through" type that would be connected to and constitute a part of the power cord. Alternatively, such a "pass-through" ballast component could be made in the form of a unit that plugs directly into the wall socket and is connected to the lighting fixture by a power cord.

We claim as our invention:

1. An electric lamp unit adapted for use in lighting apparatus that requires a compact light source and includes socket means, said lamp unit comprising, in combination;

an electric discharge lamp comprising a sealed tubular envelope of light-transmitting vitreous material and convosingle-ended construction and of such physical size that it is suitable for use in said lighting apparatus and the socket means thereof.

2. The compact electric lamp unit of claim 1 wherein said convoluted tubular envelope and light-transmitting housing are both disposed in upstanding position relative to the base structure.

3. The compact electric lamp unit of claim 2 wherein the light-transmitting housing is held in assembled relationship with the convoluted envelope by the base structure.

4. The compact electric lamp unit of claim 1 wherein said circuit means is of the solid-state type.

5. The compact electric lamp unit of claim 4 wherein the solid-state circuit means is disposed within the base structure.

6. The compact electric lamp unit of claim 1 wherein;

the light-transmitting housing is releasably secured to the base structure, said base structure includes first electrical-connector means located adjacent the substantially straight leg segments of the convoluted lamp envelope that terminate the discharge channel, and said channel-terminating leg segments of the convoluted lamp envelope carry second electrical-connector means that are connected to the lead-in conductors and are releasably coupled and connected to said first electrical-connector means so that the discharge lamp can be disconnected and removed from the lamp unit and thus comprises a readily replaceable part thereof.

7. The compact electric lamp unit of claim 6 wherein said first and second electrical-connector means are structured to provide a plug-in type connection.

8. The compact electric lamp unit of claim 7 wherein;

said first electrical-connector means comprises a plurality of rigid contactor elements that are connected to the lead-in conductors and secured to the associated leg segments of the convoluted lamp envelope, and said second electrical-connector means comprises a socket-like component that is located in and anchored to the base structure and has receptacles that are oriented to receive and effect an electrical juncture with the contactor elements on the leg segments of the lamp envelope.

9. The compact electric lamp unit of claim 1 wherein said convoluted tubular envelope has four substantially straight leg segments that are joined by three U-bent segments and together therewith form three generally U-shaped sections which define an elongated discharge channel of serpentine configuration, the two leg segments that terminate discharge channel and contain the electrodes being disposed in paired side-by-side relationship adjacent the U-bent segment that constitutes the medial portion of the convoluted envelope.

10. The compact electric lamp unit of claim 1 wherein said circuit means includes a ballast component which permits the convoluted discharge lamp to be operated on an alternating-current power supply.

11. The compact electric lamp unit of claim 10 wherein;

the substantially straight leg segments of the convoluted lamp envelope are disposed in columnar array and of such size that an open space is provided therebetween which extends from said base structure, and said ballast component is of elongated configuration and disposed in said open space between the respective leg segments of the convoluted envelope.

12. The compact electric lamp unit of claim 10 wherein;

said base structure defines a hollow chamber, and said ballast component is disposed within said chamber.

13. The compact electric lamp unit of claim 1 wherein said ionizable medium comprises a gaseous filling at a pressure below about 10 torrs and said convoluted discharge lamp is thus of the low-pressure type.

14. The compact electric lamp unit of claim 13 wherein said circuit means includes a starter component and a ballast component which are electrically arranged to permit the convoluted low-pressure discharge lamp to be operated on an alternating-current power supply.

15. The compact electric lamp unit of claim 14 wherein said starter component is located within the confines of said base structure.

16. The compact electric lamp unit of claim 13 wherein;

the convoluted discharge lamp is supported in upstanding position relative to said base structure, the housing of light-transmitting material is held in enclosing relationship with the discharge lamp by the base structure, and said housing and base structure each have at least one opening therein which permits air to pass through the lamp unit and dissipate heat that is generated by the discharge lamp when the lamp unit is energized and in use.

17. The compact electric lamp unit of claim 16 wherein;

said low-pressure discharge lamp comprises a fluorescent lamp, the convoluted vitreous envelope whereof is of triple-U-bent construction and has four substantially straight leg segments that are joined by three U-bent segments and together therewith form three conjoined U-shaped sections which define a serpentine discharge channel, and the terminal means of said base structure comprises a threaded base member that has a pair of spaced contacts and thus provides a longitudinally extending screw-in type connector for the fluorescent lamp unit.

18. The compact electric lamp unit of claim 17 wherein;

said base structure contains a plug-in type socket component that is located proximate the end of the triple-U-bent fluorescent lamp, and the electrode-containing leg segments that terminate the triple-U-bent envelope carry pin connectors which are in slip-fitted engagement and electrical contact with the plug-in type socket component and thus provide an electrical juncture which permits the convoluted fluorescent lamp to be easily removed from the screw-in lamp unit and replaced.

19. The compact electric lamp unit of claim 17 wherein;

the U-bent segments of the triple-U-bent envelope are of such curvature and so oriented that the substantially straight leg segments are disposed in substantially quadrangular columnar array and the leg segments which terminate the discharge channel are disposed in paired side-by-side relationship on the same side of the U-bent segment which constitutes the medial portion of the envelope, and said light-transmitting housing extends around and constitutes a protective cover for the convoluted fluorescent lamp.

20. The compact electric lamp unit of claim 19 wherein;

the base structure has a cup-shaped portion that accommodates the ends of the paired leg segments of the triple-U-bent envelope and laterally extends beyond the medial U-bent segment thereof, the protective cover is seated on and supported by the cup-shaped portion of the base structure, said circuit means includes a ballast component which permits the convoluted fluorescent lamp to be operated on an alternating-current power supply, and said protective cover and base structure have a plurality of vent openings therein that are adapted to permit air to pass through the operating lamp unit and thereby dissipate heat generated by the ballast component and convoluted fluorescent lamp.

21. The compact electric lamp unit of claim 20 wherein;

the four substantially straight quadrangular-columnar-arrayed leg segments of the triple-U-bent lamp envelope are spaced from one another and thus provide a central opening, and said ballast component is of the choke type and of elongated configuration and such dimensions that it is disposed in said central opening that longitudinally extends between the respective leg segments of the convoluted lamp envelope.

22. The compact electric lamp unit of claim 20 wherein;

the portion of said base structure between the cup-shaped portion thereof and the threaded base member defines a chamber, and said ballast component is disposed within said chamber.

23. The compact electric lamp unit of claim 22 wherein the chamber-defining portion of the base structure which contains the ballast component is vented to permit the circulation of air through said chamber.

24. The compact electric lamp unit of claim 13 wherein;

said low-pressure electric discharge lamp comprises a fluorescent lamp, the convoluted tubular envelope of said fluorescent lamp is disposed in upstanding position relative to the base structure, and the light-diffusing housing is disposed in jacketed relationship with the convoluted lamp envelope and constitutes a protective cover therefor that is supported in such position by the base structure, said cover and base structure each having at least one vent opening therein which permits the circulation of air through the lamp unit when the latter is energized and in use.

25. The compact electric lamp unit of claim 24 wherein said protective cover comprises a tubular sleeve that has a domed end portion with a central vent opening.

26. The compact electric lamp unit of claim 24 wherein said protective cover comprises a tubular sleeve having an end wall portion that has a plurality of spaced apertures therein which serve as the vent means.

27. The compact lamp unit of claim 27 wherein said apertures are of slot-like configuration and disposed in circumferentially spaced relationship around the end wall portion of the sleeve, the portions of the sleeve extending along the upper edges of the apertures being flared outwardly and providing louvers for the respective apertures.

28. The compact electric lamp unit of claim 24 wherein;

said protective cover comprises a tubular sleeve having an end wall portion that has a plurality of vent openings therein and merges with a longitudinally extending tubular member of smaller dimension that defines a chimney-like passageway which extends through said end wall portion to the opposite end of the cover, and said circuit means includes an elongated ballast component that extends upwardly from the base structure into the chimney-like passageway of the protective cover, the U-bent sections of the convoluted fluorescent lamp being disposed in the space between the inner and outer tubular portions of said cover.

29. An electric lamp unit adapted for use in lighting apparatus that requires a compact light source and includes socket means that is connected to circuit means which constitutes an integral part of said lighting apparatus, said lamp unit comprising, in combination;

a low-pressure type electric discharge lamp comprising a sealed tubular envelope of light-transmitting vitreous material and convoluted configuration that contains an ionizable medium and a pair of electrodes and has a plurality of conjoined generally U-shaped sections which define a single discharge channel, said generally U-shaped sections being disposed in different planes and oriented so that the substantially straight leg segments of the generally U-shaped sections are in tridimensional array and two of said leg segments are positioned adjacent one another and terminate the discharge channel, said electrodes being located within the channel-terminating leg segments of the convoluted tubular envelope and connected to lead-in conductors that extend therefrom, a protective housing of light-transmitting material disposed in protective enclosing relationship with the discharge lamp and having a vent opening therein that allows heated air to escape from the housing, and a base structure having terminal means adapted to effect electrical contact with the socket means of said lighting apparatus, said base structure being coupled to the channel-terminating leg segments of the convoluted tubular envelope and together with said discharge lamp and housing constituting a compact lamp unit of such physical size that it is suitable for use in said lighting apparatus and the socket means thereof, said circuit means being of a type that permits said discharge lamp to be operated on an alternating current power source.

30. An electric lamp unit adapted for use in lighting apparatus that requires a compact light source and includes socket means, said lamp unit comprising in combination;

a low-pressure type electric discharge lamp comprising a sealed tubular envelope of light-transmitting vitreous material and convoluted configuration that contains an ionizable medium and a pair of electrodes and has a plurality of conjoined generally U-shaped sections which define a single discharge channel, said generally U-shaped sections being disposed in different planes and oriented so that the convoluted envelope is of compact tridimensional configuration and two of said leg segments are disposed adjacent one another and terminate the discharge channel, said electrodes being located within the channel-terminating leg segments of the convoluted tubular envelope and connected to lead-in conductors that extend therefrom, and said discharge lamp being of a type that inherently exhibits a decrease in light output when operated in an environment that causes the lamp to become overheated, a base structure having terminal means adapted to effect electrical contact with the socket means of said lighting apparatus, said base structure having at least one vent opening therein and being coupled to the channel-terminating leg segments of the convoluted tubular envelope and together with said envelope constituting a compact unitary assembly, and a light-transmitting cover disposed in protective enclosing relationship with said discharge lamp and having vent means which cooperates with the vented base structure and permits air to pass through the operating lamp unit and convection cool the discharge lamp.

* * * * *